United States Patent [19]

Lehmann et al.

[11] Patent Number: 4,581,904

[45] Date of Patent: Apr. 15, 1986

[54] TOY JEWELRY ITEM WITH PARTS MOVABLE TO A HIDDEN POSITION

[76] Inventors: Roger W. Lehmann, 18 Flintlock Ct., Bernardsville, N.J. 07924; Michael I. Satten, 85 Maple Dr., Great Neck, N.Y. 11021

[21] Appl. No.: 683,927

[22] Filed: Dec. 20, 1984

[51] Int. Cl.[4] ..... A44C 25/00; A63H 3/16; A63H 33/00

[52] U.S. Cl. ..... 63/23; 63/19; 63/31; 446/99; 446/73; 446/310; 446/376; 446/487

[58] Field of Search ..... 63/1, 2, 19, 23, 31, 63/18, 15; 446/97, 99, 100, 72, 73, 376, 487, 310

[56] References Cited

U.S. PATENT DOCUMENTS

| | | | |
|---|---|---|---|
| 152,250 | 6/1874 | Powers | 446/487 |
| 699,780 | 5/1902 | Woerner | 446/72 |
| 770,573 | 9/1904 | Hacherelle | 63/23 |
| 803,386 | 10/1905 | Allen | 446/310 X |
| 972,147 | 10/1910 | Averill | 446/310 |
| 1,099,733 | 6/1914 | Beetar | 63/19 X |
| 2,109,609 | 3/1938 | Aull | 63/1 R X |
| 2,769,249 | 11/1956 | Illes | 63/19 X |
| 3,568,467 | 3/1971 | Ellison | 63/29 R |
| 3,686,894 | 8/1972 | Handler et al. | 63/1 R |
| 4,411,097 | 10/1983 | Murakami | 446/487 |

FOREIGN PATENT DOCUMENTS

| | | | |
|---|---|---|---|
| 43676 | 6/1908 | Switzerland | 63/19 |
| 2120111 | 7/1983 | United Kingdom | 446/72 |

*Primary Examiner*—F. Barry Shay
*Attorney, Agent, or Firm*—Alan H. Levine

[57] ABSTRACT

A toy jewelry item including a case having front and back portions relatively movable between closed and open conditions. At least one part is movably carried by one of the case portions, the part being movable between an exposed position in which it projects outwardly from the external contour of the case and a hidden position in which it is located completely within the external contour of the case. The case can be closed completely regardless of whether the part is in its exposed or its hidden position. The part or parts may simulate parts, such as the head and extremities, of a living thing. Subparts may be movably carried by the part.

17 Claims, 13 Drawing Figures

FIG. 3
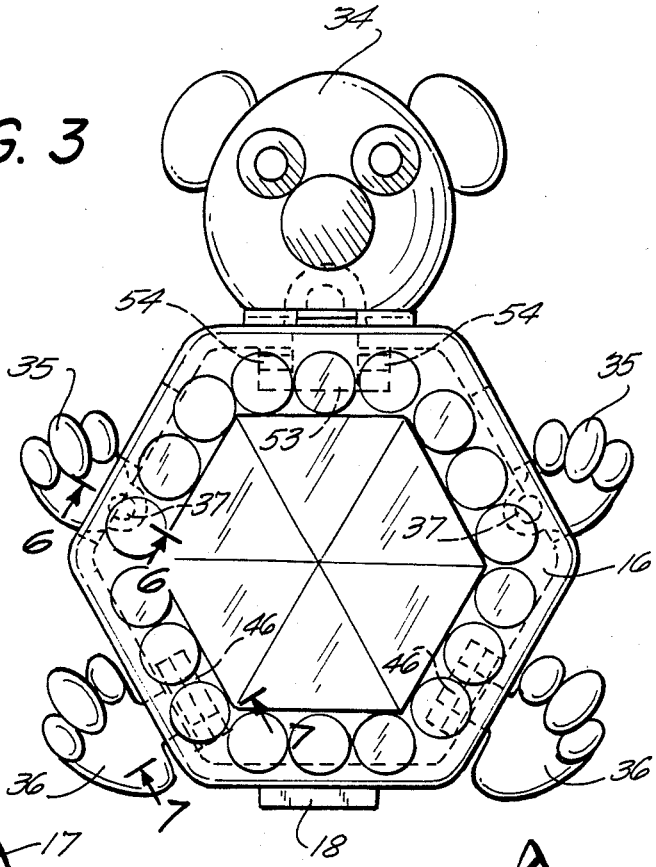
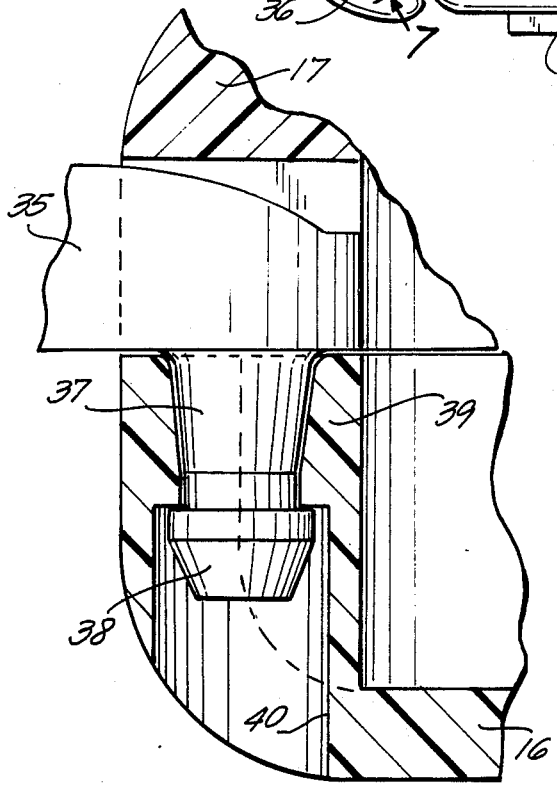
FIG. 6
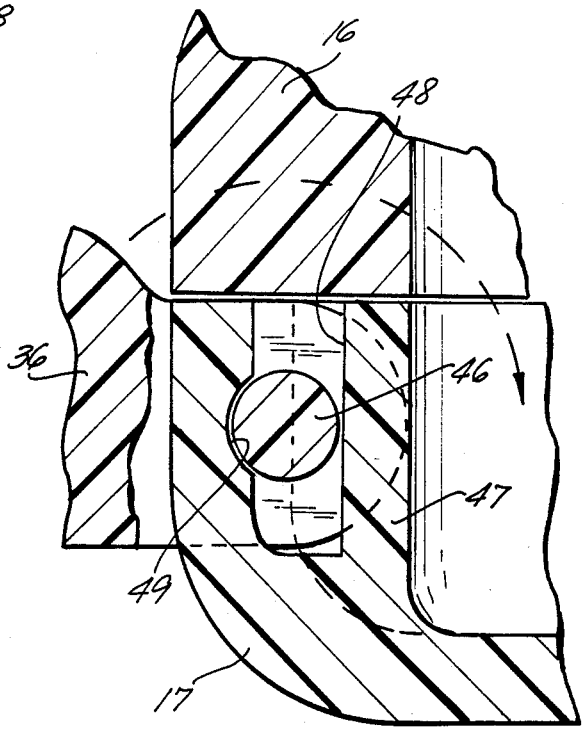
FIG. 7

FIG. 8
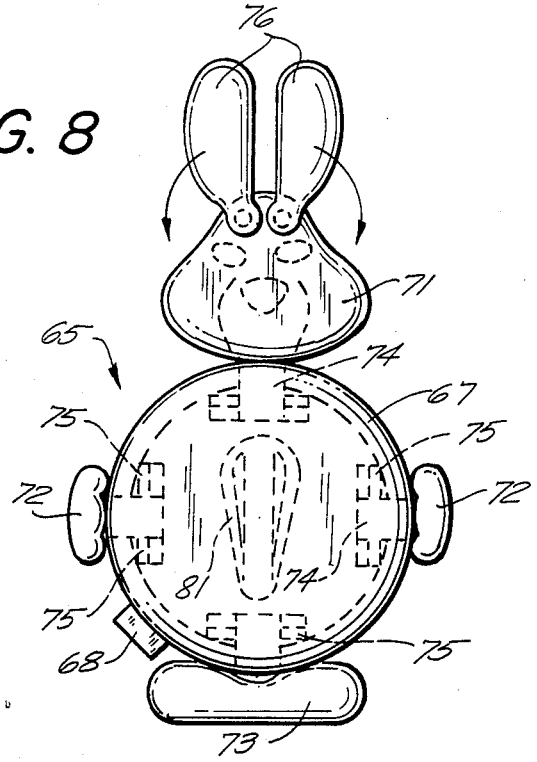
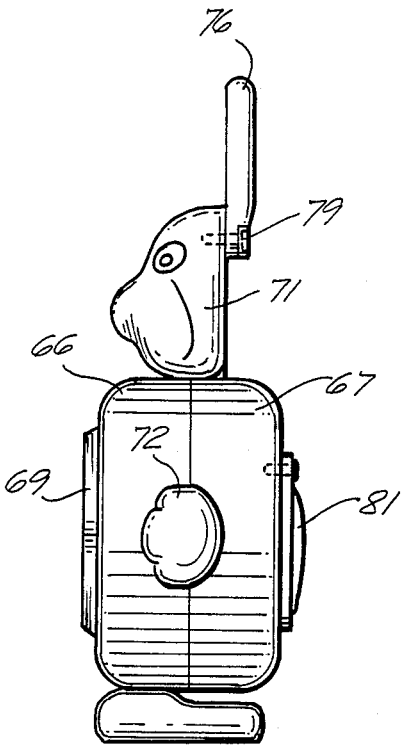
FIG. 9
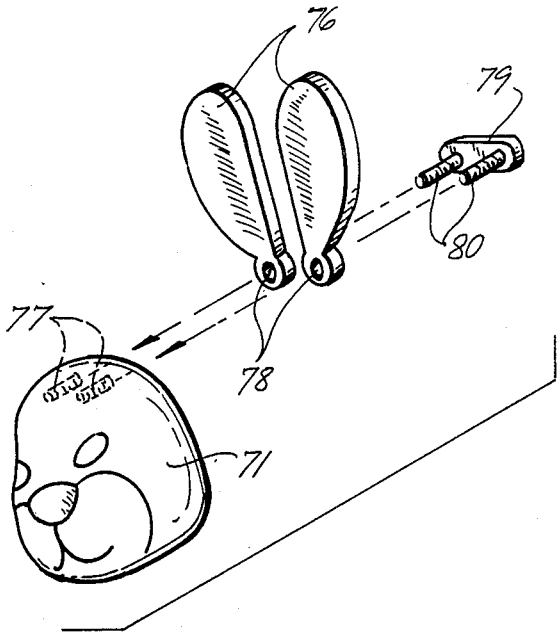
FIG. 10

FIG. 13
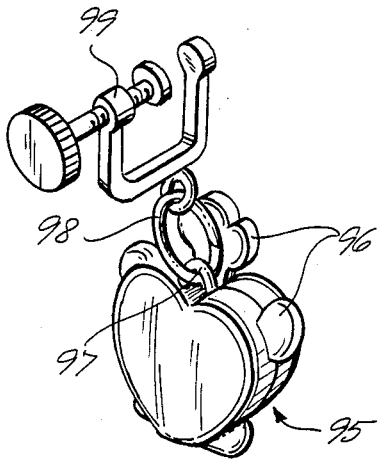
FIG. 12
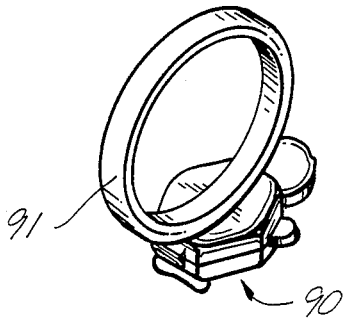
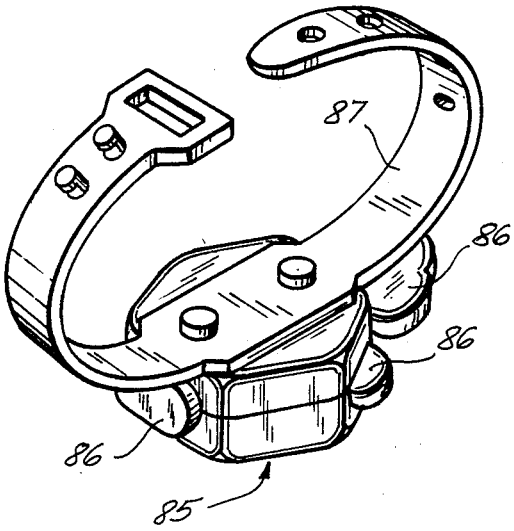
FIG. 11

TOY JEWELRY ITEM WITH PARTS MOVABLE TO A HIDDEN POSITION

This invention relates to toys, and more particularly to toy ornaments intended to be worn by a child in the manner of jewelry.

Toy jewelry has been available in the past. However, these toys have attempted to replicate real jewelry, and hence have been limited in their utility to being worn in the manner of actual jewelry. As a result, the play value of such toy jewelry has been somewhat limited.

It is an object of the present invention to provide a toy jewelry item which not only can be worn on the body for ornamentation, but which also comprises features which can be played with in a manner unrelated to its function as an item of jewelry.

It is another object of the invention to provide a toy jewelry item which can be transformed between one form and another, and which can be worn while in either form.

It is a further object of the invention to provide such a toy jewelry item which in one of its forms simulates the appearance of an animal or some other living or non-living thing.

Additional objects and features of the invention will be apparent from the following description, in which reference is made to the accompanying drawings.

In the drawings

FIG. 3 is a front elevational view of the item in its extended condition;

FIG. 6 is a fragmentary cross-sectional view, on an enlarged scale, taken along line 6—6 of FIG. 3;

FIG. 7 is a fragmentary cross-sectional view, on an enlarged scale, taken along line 7—7 of FIG. 3;

FIG. 8 is a front elevational view of another embodiment of a toy jewelry item according to the present invention;

FIG. 9 is a side elevational view of the item shown in FIG. 8;

FIG. 10 is an exploded perspective view of some of the parts of the item shown in FIG. 8;

Figure 1:
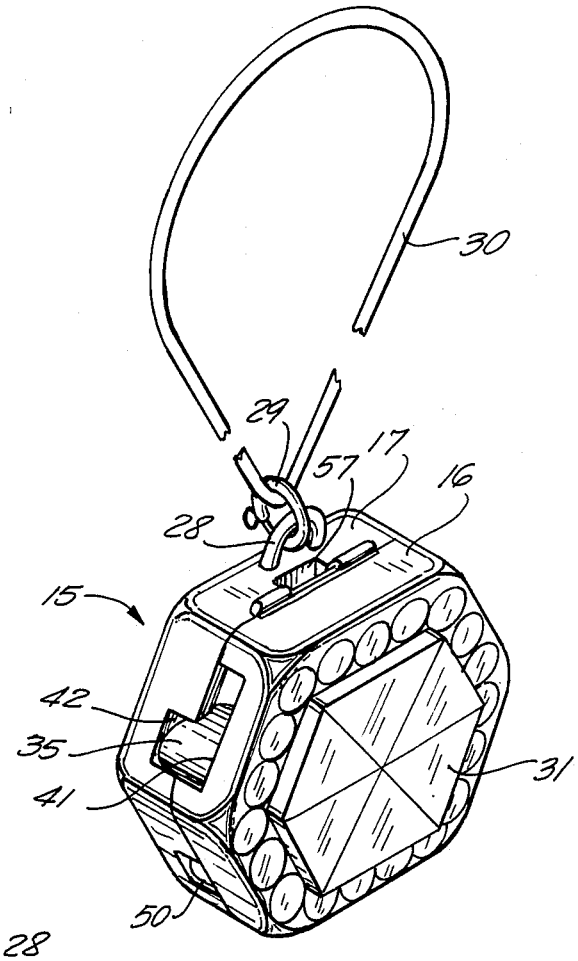
FIG. 1 is a perspective view of a toy jewelry item according to the present invention, the item being in its retracted condition.

FIGS. 11, 12, and 13 are additional embodiments of toy jewelry items according to the present invention.

The jewelry item chosen to illustrate the present invention, and shown in FIGS. 1-5, is a pendant. The item includes a case 15 having a front portion 16 and a back portion 17. Portions 16 and 17 are joined together at one side of the case by a hinge 18. Preferably, case portions 16 and 17, and hinge 18, are molded as a single piece of plastic.

Figure 5:
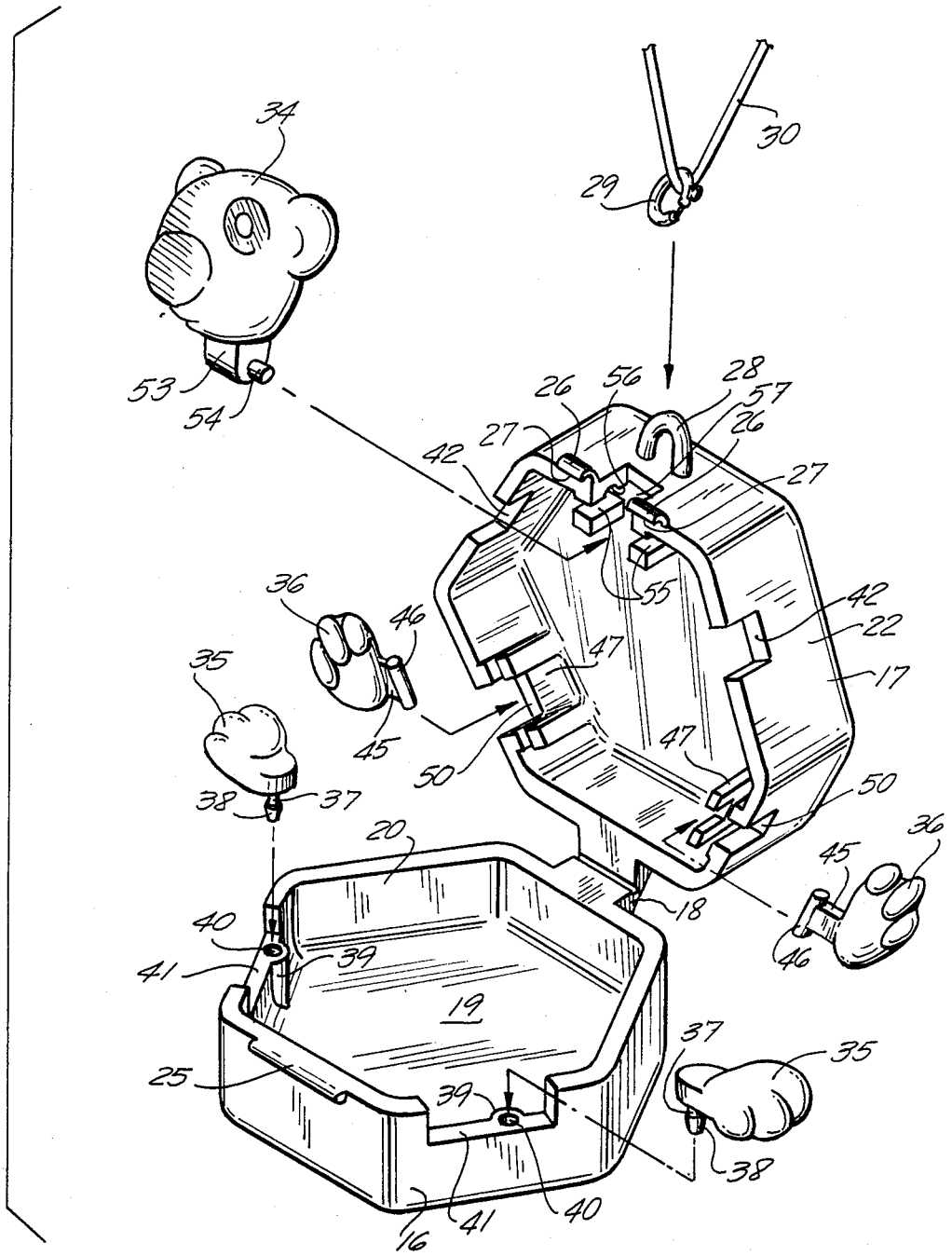
FIG. 5 is an exploded perspective view of the item.

Front portion 16 has a main wall 19 and a side wall 20 extending around its perimeter (see FIG. 5), and similarly back portion 17 has a main wall 21 and a side wall 22 extending around the perimeter of the main wall. Front and back portions 16 and 17 may be swung away from each other, about the axis of hinge 18, to expose the interior of the case, as indicated in FIG. 5. Portions 16 and 17 can also be swung toward each other, until the edges of side walls 20 and 22 touch each other, in order to close the case and hide its hollow interior.

Side wall 20 of front portion 16 is formed, near its free edge, with an outwardly projecting ridge 25. Side wall 22 of back portion 17 is formed, near its free edge, with two outwardly extending lips 26, each lip having a slot 27. When the case is closed, i.e., the front and back portions are swung toward each other so that the free edges of their side walls engage, lips 26 snap over the opposite end portions of ridge 25, i.e., the end portions of the ridge enter slots 27 and are frictionally held within the slots. In this way, lips 26 and ridge 25 serve as a clasp for maintaining the case portions in their fully closed condition Projecting outwardly from side wall 22 of back portion 17 is a loop 28, which may be formed integrally with back portion 17. A ring 29 may be placed through loop 28, and a chain or cord 30 passes through ring 29. The pendant may be worn by placing chain or cord 30 around the neck. The exterior of main wall 19 of front portion 16 may be shaped to simulate a jewel or jewels 31. Preferably, however, the jewels 31 are formed separately and applied to the outer surface of front portion 16, such as by adhesive.

Figure 2:
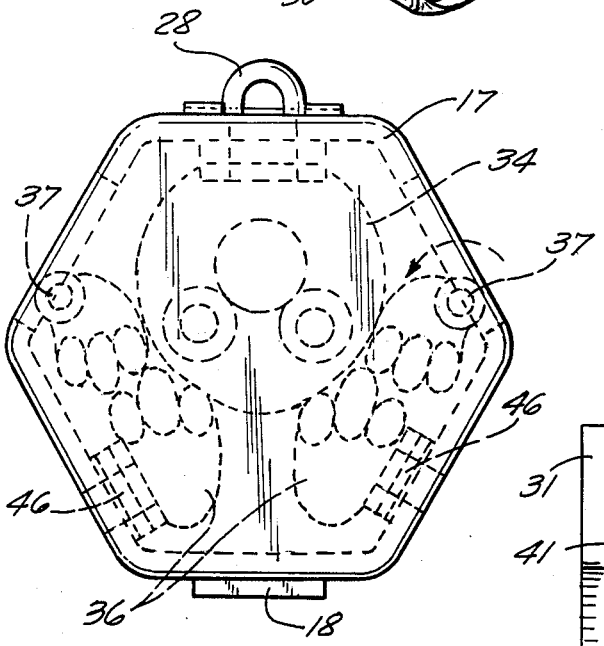
FIG. 2 is a front elevational view of the item in its retracted condition.
Figure 4:
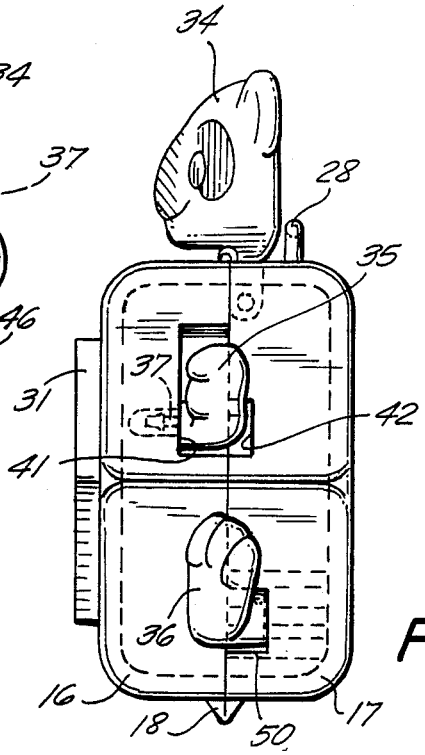
FIG. 4 is a side elevational view of the item in its extended condition.

Case 15 carries a number of movable parts. In this example, five such parts are shown simulating parts of the body of an animal. Specifically, the parts include a head 34, two front paws 35, and two rear paws 36. Each of the parts 34–36 is pivotally mounted on one of the case portions 16 and 17, so that the parts can be swung into the case, as shown in FIGS. 1 and 2, or swung out of the case, as shown in FIGS. 3 and 4. In both conditions, i.e., parts 34–36 within the case and outside the case, the case 15 can be completely closed, as shown clearly in FIGS. 1 and 4.

Each of the front paws 35 is formed with a laterally-projecting spindle 37 (FIGS. 4, 5, and 6) formed with an enlarged head 38. Side wall 20 of front portion 16 is formed with two thickened regions 39 each of which is formed with a bore 40. Bore 40 has a section which is slightly tapered, conforming to the taper of spindle 37, and a section having an enlarged diameter. Each paw 35 is assembled with front portion 16 by forcing the head 38 of spindle 37 through the tapered section of bore 40 until head 38 snaps past the shoulder defined at the plane where the enlarged diameter portion of bore 40 meets the tapered portion. The inherent resilience of the material of which the parts are made permits this type of assembly. It will be appreciated that when assembled, as shown in FIG. 6, paw 35 cannot be pulled from case portion 16. However, it is free to rotate about the axis of spindle 37. In the region of each thickened portion 39, side wall 20 is formed with a notch 41. Each notch 41, together with a corresponding notch 42 in side wall 22 of back portion 17, provides an opening in the side wall for accommodating the inner end of paw 35 so that the paw will not interfere with closing of the case.

Each rear paw 36 is formed with an extension 45 carrying a spindle 46. Side wall 22 of back portion 17 has two thickened regions 47 each formed with a slot 48 extending generally parallel to the side wall. The width of slot 48 is generally less than the diameter of spindle 46. However, about half way down the depth of each slot 48, one side wall of the slot is provided with a part-circular groove 49 (FIG. 7) extending along the length of the slot.

Each rear paw 36 is assembled with case portion 17 by forcing its spindle 46 into slot 48 until the spindle snaps into groove 49. In this way, paw 36 cannot readily be separated from case portion 17, but it can pivot with respect to the case about the axis of spindle 46. In the region of each thickened portion 47, side wall 22 is formed with a notch 50 for accommodating extension 45 of paw 36. This notch, therefore, permits the case to completely close without interference from extensions 45.

Head 34 is mounted on back portion 17 in a manner similar to that just described with respect to rear paws 36. An extension 53, projecting from head 34, carries two pintles 54 (FIGS. 3 and 5). To assemble head 34 with back portion 17, pintles 54 are forced into slots 55, formed in a thickened region of side wall 22, until the pintles snap into grooves 56. In this way, head 34 cannot readily separate from back portion 17, but it is rotatable about the axis of pintles 54. A notch 57 in side wall 22 accommodates extension 53 so as to prevent the extension from interfering with complete closing of the case 15.

When case 15 is open, as illustrated in FIG. 5, head 34 and paws 35 and 36 can be swung into the interior of the case portions which carry them, and the case can then be closed. The pendant will then appear as shown in FIGS. 1 and 2. If the case is then reopened, head 34 and paws 35 and 36 can be swung outwardly, so that they project from the case, and the case can then be reclosed. The pendant will appear as shown in FIGS. 3 and 4. The pendant can be worn in either of these two conditions, i.e., parts 34–36 hidden within the case 15 or exposed projecting from the case.

FIGS. 8–10 illustrate another embodiment of the invention. Case 65 comprises a front portion 66 and a back portion 67, these portions being joined by a hinge 68. Front portion 66 carries a simulated jewel or jewels 69.

A head 71, simulating the head of a rabbit, front paws 72, and rear paws 73 are assembled with the case, for pivotal movement, in a manner similar to that described above with respect to head 34. Specifically, each of the parts 71–73 is formed with an extension 74 from which projects two pintles 75. The pintles are captured within slots carried by the case portions.

In this example, the simulated ears 76 of the animal are subparts formed separately from head 71. The back of head 71 is formed with two bores 77, and a hole 78 in each ear 76 is aligned with one of the bores 77. A fastener 79 presents two pins 80 which pass through holes 78 in ears 76 and are force fit into bores 77. In this way, ears 76 are maintained in assembled condition with head 71, but each ear is permitted to pivot about the axis of its respective pin 80.

In FIGS. 8 and 9, the toy jewelry item is shown in extended condition, with head 71 and paws 72 and 73 projecting outwardly from the closed case. In order to transform the item to its retracted condition, the case is opened, and paws 72 and 73 are swung into the case. Before head 71 can be swung into the case, ears 76 must first be swung so that they overlap the head. Unless the ears are so moved, they will not be accommodated within the case when head 71 is swung into the case.

Attached to the external surface of back portion 67 is a clip 81 capable of engaging the hair of the wearer. As a result, the item shown in FIGS. 8 and 9 can be worn as a barrette. The clip can also be used to attach the jewelry item to the edge of a pocket or lapel, to a belt, or to a band worn around the head or wrist. It should be noted that the item can be worn in the hair, or otherwise, in either its extended condition, shown in the drawings, or its retracted condition, in which parts 71, 72, and 73 are located within the case.

FIG. 11 shows a case 85, carrying movable parts 86 similar to the case and parts described above with respect to FIGS. 1–10. Case 85 is mounted on a strap or band 87 which can be fixed around the wrist of a wearer. Thus, in this case, the jewelry item is a bracelet.

FIG. 12 shows a case 90, also having movable parts, as described above, mounted on a ring 91. Thus, in this case the toy jewelry item is a decorative ring.

FIG. 13 shows a case 95 having movable parts 96, similar to the case and parts described above. Case 95 is attached, by means of a loop 97 and ring 98 to a clasp 99 adapted to grip an earlobe. Thus, in this case, the toy jewelry item is an earring.

Each of the jewelry items shown in FIGS. 11–13 can be worn with the movable parts exposed, as shown, or hidden within the case. Thus, in all its embodiments, the invention provides a jewelry item which can be worn in either of its two conditions, i.e., movable parts extended or retracted. In addition, it will be appreciated that the toy offers the opportunity for manipulating the moving parts, to transform the case, having no projecting parts, into a simulated animal or the like, which can be played with as toy figures are usually played with. Thus, the play value of the toy jewelry item is obviously enhanced.

The drawings illustrate that the case may have a hexagonal shape (FIGS. 1–5), a circular shape (FIGS. 8 and 9), or a heart shape (FIG. 13). It is to be understood that the case may be given any suitable shape, as long as its hollow interior is adequate to accommodate the movable parts when they are moved into the case. Furthermore, although the drawings illustrate the item as simulating an animal when in its extended condition, the item could simulate other living things, such as humans or birds, and non-living things, such as robots and vehicles.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A toy jewelry item comprising:

a case having a front portion and a back portion, those portions being relatively movable between a closed condition, in which they enclose the hollow interior of the case, and an open condition, in which the hollow interior is exposed, a plurlaity of parts movably attached to the case, the case and parts being shaped to simulate a body and body appendage parts of a living thing, and each part being individually movable between an exposed position in which it projects outwardly from the external contour of the case and a hidden position in which it is located completely within the external contour of the case, and means for maintaining the case portions in their fully closed condition regardless of whether the parts are in their exposed or their hidden position, whereby when the case is closed and the parts are exposed the item simulates a living thing.

2. A toy jewelry item as defined in claim 1 wherein the front and back portions of the case are hinged together, so that they swing with respect to each other between their closed and open conditions.

3. A toy jewelry item as defined in claim 1 wherein one of said parts is rotatable about an axis fixed with respect to one of said portions, so that the part can be rotated between its exposed and hidden positions.

4. A toy jewelry item as defined in claim 1 wherein one of said portions has a main wall and a side wall extending from the main wall, one of said parts being carried by the side wall.

5. A toy jewelry item as defined in claim 1 wherein each of the case portions has a main wall and a side wall extending from the main wall, at least one of said parts being carried by the side wall of each case portion.

6. A toy jewelry item as defined in claim 1 wherein the parts are shaped to simulate the head and extremities of an animal.

7. A toy jewelry item as defined in claim 1 including a subpart movably carried by one of the parts, the subpart being movable between an extended position and a retracted position, the respective part being movable to its hidden position when the subpart is in its retracted position but not when the subpart is in its extended position.

8. A toy jewelry item as defined in claim 7 wherein the respective part is shaped to simulate the head of a living thing, and the subpart is shaped to simulate an ear.

9. A toy jewelry item as defined in claim 1 including decoration means carried on the exterior of at least one of the case portions.

10. A toy jewelry item as defined in claim 9 wherein the decoration means is shaped to simulate a precious stone.

11. A toy jewelry item as defined in claim 1 including means mounted on the case for attaching the jewelry item to the wearer of the item.

12. A toy jewelry item as defined in claim 11 wherein the attaching means is an elongated flexible element adapted to be placed around the neck so that the jewelry item may be worn as a pendant.

13. A toy jewelry item as defined in claim 11 wherein the attaching means is a clip adapted to engage the hair, so that the jewelry item may be worn as a barrette.

14. A toy jewelry item as defined in claim 11 wherein the attaching means is a band adapted to encircle the wrist, so that the jewelry item may be worn as a bracelet.

15. A toy jewelry item as defined in claim 11 wherein the attaching means is a ring adapted to encircle a finger.

16. A toy jewelry item as defined in claim 11 wherein the attaching means is a clasp adapted to grip an earlobe so that the jewelry item may be worn as an earring.

17. A toy jewelry item as defined in claim 11 wherein the attaching means is operable regardless of whether the part is in its exposed or hidden position.

* * * * *